US007046921B1

(12) United States Patent
Fulks

(10) Patent No.: US 7,046,921 B1
(45) Date of Patent: May 16, 2006

(54) RADIANT HEATING ELEMENT REFLECTIVE BRACKET WITH VENTILATION OPENINGS

(75) Inventor: Robert Leonard Fulks, Ellettsville, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/480,588

(22) Filed: Jan. 10, 2000

(51) Int. Cl.
*H05B 1/00* (2006.01)

(52) U.S. Cl. ..... 392/423; 428/544

(58) Field of Classification Search ..... 392/423–430, 392/407, 352–353, 376; 219/548; 362/296–298, 362/345, 347; 428/544; 248/121, 126, 200, 248/232–234, 300
See application file for complete search history.

(56) References Cited

U.S. PATENT DOCUMENTS

| | | | | | |
|---|---|---|---|---|---|
| 1,061,225 | A | * | 5/1913 | Cunningham | 392/423 |
| 1,674,017 | A | * | 6/1928 | Marsden | 392/376 |
| 1,676,834 | A | * | 7/1928 | McQuinn | 392/376 |
| 1,942,758 | A | * | 1/1934 | Jessup | 392/376 |
| 2,410,211 | A | * | 10/1946 | Gough | 392/376 |
| 2,433,137 | A | * | 12/1947 | Marr | 392/376 |
| 2,438,861 | A | * | 3/1948 | Neiser | 392/376 |
| 2,800,563 | A | * | 7/1957 | Browne et al. | 392/430 |
| 3,014,680 | A | | 12/1961 | Steinbach | |
| 3,051,816 | A | * | 8/1962 | Knoll et al. | 392/353 |
| 3,051,820 | A | * | 8/1962 | Krichton | 392/376 |
| 3,152,241 | A | * | 10/1964 | Ammerman | 392/370 |
| 3,171,945 | A | | 3/1965 | Meng et al. | |
| 3,733,461 | A | | 5/1973 | Rohats | |
| 3,825,407 | A | | 7/1974 | Fujite et al. | |
| 4,002,199 | A | | 1/1977 | Jacobs | |
| 4,010,348 | A | | 3/1977 | Salinger | |
| 5,042,267 | A | | 8/1991 | Beers et al. | |
| 5,047,786 | A | * | 9/1991 | Levy | 392/370 |
| 5,435,145 | A | | 7/1995 | Jaster | |
| 5,711,159 | A | | 1/1998 | Whipple, III | |

FOREIGN PATENT DOCUMENTS

| | | | | |
|---|---|---|---|---|
| DE | 349923 | * | 3/1922 | 392/428 |
| DE | 892950 | * | 10/1953 | 392/425 |
| GB | 473182 | * | 10/1937 | 392/422 |

* cited by examiner

*Primary Examiner*—John A. Jeffery
(74) *Attorney, Agent, or Firm*—H. Neil Houser, Esq.; Armstrong Teasdale LLP

(57) ABSTRACT

A reflective bracket for a radiant refrigerator defroster includes a channel fabricated from a reflective material and a plurality of ventilation openings through the sides and bottom of the channel. The ventilation openings reduce the operating temperature of the heater element, improve convection heating of a refrigerator evaporator, and allow direct line-of sight heating of evaporator compartment components.

15 Claims, 2 Drawing Sheets

RADIANT HEATING ELEMENT REFLECTIVE BRACKET WITH VENTILATION OPENINGS

BACKGROUND OF THE INVENTION

This invention relates generally to reflective brackets and, more particular, to a reflective bracket for a radiant heat defrost heater for a refrigerator.

Most refrigerators, as disclosed in U.S. Pat. No. 5,711,159, include an evaporator which normally operates at sub-freezing temperatures in an evaporator compartment positioned behind the freezer department. Consequently, a layer of frost typically builds up on the surface of the evaporator. As disclosed in U.S. Pat. No. 5,042,267, a radiant heater is often positioned inside a housing and below the evaporator to warm the evaporator by both convection and radiant heating in order to quickly defrost the evaporator.

A number of problems have been noted, however, with known radiant heat refrigerator defrosters. For example, radiant heaters typically operate at temperatures above the boiling point of water, and if water is allowed to impinge on the heating element during the defrost process, undesirable noises will occur. In addition, the housing surrounding the radiant heater tends to heat the radiant heater, causing the heater to operate at higher temperatures and reducing the life of the heater. Further, the increased temperature of the heater tends to create abnormal convection currents across the evaporator during defrost cycles, and undesirable pressure drops across the evaporator compartment. Still further, indirect radiant heating provided by the housing surrounding the heater tends to increase the required time for a complete defrost, and reduces defrost efficiency.

Accordingly, it would be desirable to mount a radiant defrost heater in a manner that protects the heating element from defrost water, improves convection flow in the evaporator compartment and decreases the required defrost time.

BRIEF SUMMARY OF THE INVENTION

In an exemplary embodiment of the invention, a reflective bracket for a refrigerator defroster includes a channel fabricated from a material of high emissivity, or tendency to reflect heat, and at least one ventilation opening through the channel to allow for direct line-of-sight heating of components, to improve convection flow, and to reduce the pressure drop across the evaporator compartment.

More specifically, the channel is parabolically shaped and has a longitudinal axis. At least one opening extends longitudinally at substantially the bottom of the parabolic shaped channel, and a plurality of ventilation openings extend laterally along the sides of the channel on both sides of the longitudinally extending opening. The ventilation openings allow for direct heating of components, such as a drain pan, for a more effective defrost operation. The ventilation openings reduce the amount of heat reflected back to the heater element and allow the radiant heater to operate at a reduced temperature, thereby extending the life of the heater. Further, the ventilation openings improve air flow and pressure balance within the evaporator compartment.

Additionally, an integrally formed shield protects the radiant heater from falling moisture, and integrally formed holding brackets hold a radiant heater in position relative to the channel. Thus, a convenient and durable reflective bracket for a radiant defrost heater is provided that increases defrost efficiency and reduces required defrost time. Due to the increased efficiency afforded by the reflective bracket, a lower powered heater may be used and still achieve comparable defrost performance as higher powered heaters in conventional housings.

DETAILED DESCRIPTION OF THE INVENTION

Figure 1:
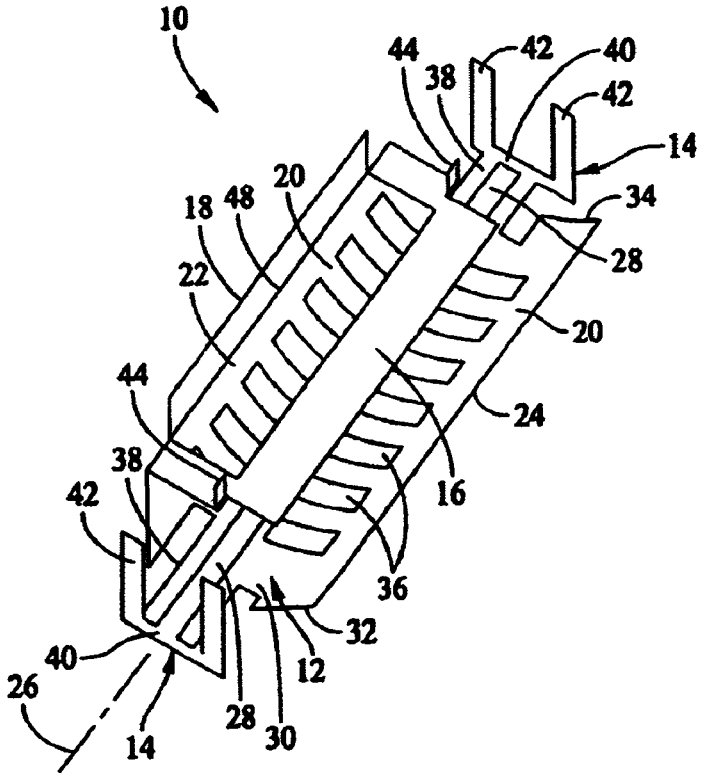
FIG. 1 is a perspective view of a reflective bracket.

FIG. 1 is a perspective view of a reflective bracket 10 for a radiant defroster (not shown) for a refrigerator (not shown) including a channel 12, holding brackets 14, a shield 16, and a flap 18.

Channel 12 is made of a lightweight material with a high emissivity, or tendency to reflect radiant energy, such as extruded aluminum. Alternatively, or in combination with high emissivity materials, channel 12 can be finished to improve the reflectivity of channel 12, such as by providing a polished, mirror-like channel surface 20. Channel 12 is substantially parabolic in shape and has a first side 22 and second side 24 extending along a longitudinal axis 26 and forming channel surface 20. A longitudinal ventilation opening 28 extends through channel 12 substantially at a bottom 30 of parabolic channel surface 20 on a first end 32 and second end 34 of channel 12 and substantially separates the first and second channel sides 22 and 24. A plurality of laterally extending ventilation openings 36 extend along first and second sides 22 and 24. Longitudinally extending openings 28 are separated from laterally extending openings 36 along channel surface 20, and laterally extending openings 36 are generally aligned in rows on opposite channel sides 22 and 24. Laterally extending ventilation openings 36 extend along parabolic channel surface 20 obliquely to longitudinal ventilation opening 28.

Holding brackets 14 extend from a first end 32 and a second end 34 of channel 12 and include a cantilever extension 38 extending from bottom 30 of channel surface 20 and partially defining longitudinally extending openings 28 on each end 32, 34 of channel 12. A holding bracket base 40 extends from said cantilever extension 38, and upwardly turned fingers 42 extend from base 40. Base 40 and fingers 42 are dimensioned and positioned relative to one another to support a radiant heating element (not shown in FIG. 1) between holding brackets 14 and within channel 12.

Shield 16 extends from channel first side 22 on each end 32, 34 of channel 12 and covers a center portion of channel 12 substantially over longitudinally extending ventilation openings 28. An upwardly turned mounting interface 44 on either side of shield 16 includes a mounting opening 46 (see FIG. 2) for installation purposes. A rectangular flap 18, or cutout, from shield 16 extends from a top 48 of channel first side 22.

Figure 2:
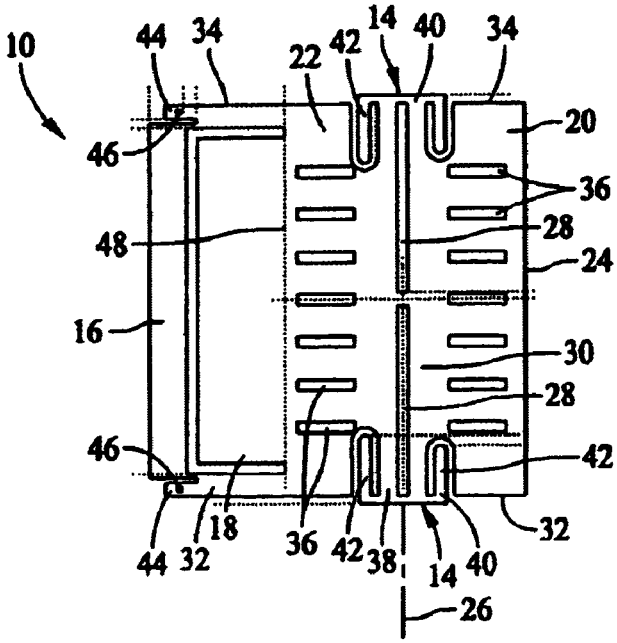
FIG. 2 is a flat panel view of the bracket shown in FIG. 1.

FIG. 2 is a flat panel view of reflective bracket 10 before it is formed into the shape shown in FIG. 1. Channel first side 22 and second side 24 are substantially separated by longitudinal ventilation openings 28 extending along longitudinal axis 26 between channel first end 32 and channel second end 34. A plurality of laterally extending ventilation openings 36 extend along channel first and second sides 22 and 24, and are generally aligned in rows on opposite channel sides 22 and 24 on either side of longitudinally extending openings 28. Holding brackets 14 extend from channel first end 32 and channel second end 34 and include cantilever extensions 38 extending along longitudinal axis 26. Holding bracket bases 40 extend laterally from the cantilever extension 38, and fingers 42 extend longitudinally from bases 40 toward laterally extending openings 36.

Shield 16 extends from channel first side 22 between each channel end 32, 34. Mounting interfaces 44 on either side of shield 16 include mounting holes 46. A rectangular flap 18, or cutout, from shield 16 extends from a top 48 of channel first side 22 parallel to shield 16.

The flat panel of FIG. 2 is appropriately bent and folded into the shape of FIG. 1. Specifically, first and second sides 22 and 24 are bent into a parabolic shape to form channel 12 (FIG. 1). Shield 16 is folded across top 48 of first channel side 22 to cover center portion of channel 12 between channel sides 22 and 24. Mounting interfaces 44 are folded upward at each end of shield 16. Finally, holding brackets 14 are bent upwardly to hold a radiant heater element (not shown).

Figure 3:
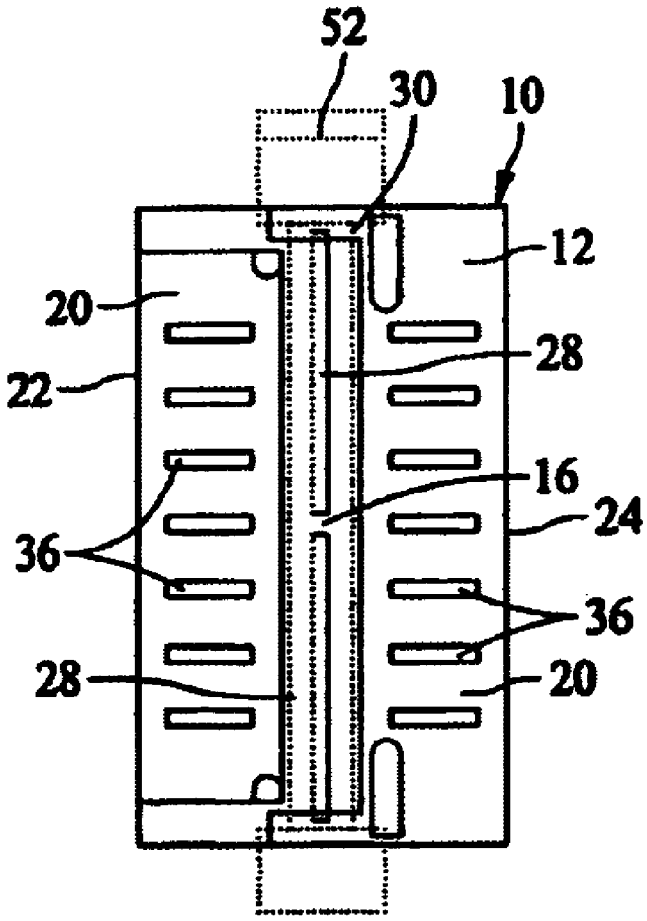
FIG. 3 is a top plan view of the bracket shown in FIG. 1 attached to a radiant heater element.

FIG. 3 illustrates reflective bracket 10 connected to a radiant heater element 52 (shown in phantom). Shield 16 substantially covers heater element 52 and prevents falling ice or water from hitting heater element 52 and creating thermal transients and unpleasant noises. Longitudinally extending apertures 28 provide ventilation underneath heater element 52 and substantially prevent heat from being reflected from bottom 30 of parabolic channel 12 to heater element 52 and substantially raising the operating temperature of heater element 52. Longitudinally extending openings 28 underneath heater element 52 also improve natural convection heating of the evaporator (not shown) during the defrost cycle.

Laterally extending ventilation openings 36 along channel sides 22, 24 allow direct line-of-sight heating of desired defrost cycle components, such as a drain pan (not shown), to increase defrost cycle efficiency. Convection currents are further improved by laterally extending ventilation openings 36. Reflective, parabolic channel surface 20 between laterally extending openings 36 redirects radiant heat from radiant heater element 52 elsewhere throughout the compartment. Therefore, the total power output of the defrost system is reduced due to more efficient use of heat from radiant heater element 52. Increased defrost efficiency due to the reflectivity of reflective bracket 10 allows a lower power radiant heater to be used and still maintain a performance level comparable to conventional defrost systems using higher powered heaters.

As a result of ventilation openings 28, 36, less heat is reflected back to heater element 52 so heater element 52 burns cooler. Consequently the life of heater element 52 is extended. The lower operating temperature of heating element 52 has a further benefit of reducing air-pressure drop across the evaporator compartment during forced airflow cooling of the evaporator compartment.

While the invention has been described in terms of various specific embodiments, those skilled in the art will recognize that the invention can be practiced with modification within the spirit and scope of the claims.

The invention claimed is:

1. A reflective bracket comprising:

a channel comprising a reflective material, a longitudinal axis, and at least one ventilation opening therethrough, said at least one ventilation opening positioned substantially at a bottom of said channel, and configured to prevent a reflection of heat from said bottom of said channel, said channel including a first side and a second side, one of said first and second sides including channel ends formed thereon; and a shield extending from said channel ends and positioned proximate said channel bottom, said shield configured to substantially cover a heating element mounted between said shield and said channel bottom.

2. A reflective bracket in accordance with claim 1 wherein said channel has a parabolic shape.

3. A reflective bracket in accordance with claim 1 wherein said at least one ventilation opening extends longitudinally along said channel.

4. A reflective bracket in accordance with claim 1 wherein said shield is integral with said channel.

5. A reflective bracket in accordance with claim 1 wherein said channel comprises a first side and a second side, said at least one ventilation opening extending laterally along said sides of said channel.

6. A reflective bracket in accordance with claim 5 further comprising a flap extending from one of said first side and said second side.

7. A reflective bracket in accordance with claim 1 further comprising at least one holding bracket extending from an end of said channel.

8. A reflective bracket in accordance with claim 7 wherein said at least one holding bracket is integrally formed with said channel.

9. A reflective bracket comprising:

a channel comprising a reflective material, a longitudinal axis, and at least a first ventilation opening and a second ventilation opening therethrough, said first ventilation opening and said second ventilation opening extending obliquely to one another, said first ventilation opening positioned substantially at a bottom of said channel, and configured to prevent a reflection of heat from said bottom of said channel, said channel including a first side and a second side, one of said first and second sides including channel ends formed thereon; and a shield extending from said channel ends and positioned proximate said channel bottom, said shield, configured to substantially cover a heating element mounted between said shield and said channel bottom.

10. A reflective bracket in accordance with claim 9 wherein the channel comprises a first side and a second side, said first ventilation opening extending longitudinally along said channel, and said second ventilation opening extending laterally along the sides of said channel.

11. A reflective bracket in accordance with claim 10 further comprising a third ventilation opening extending laterally along said sides of said channel, said at least first ventilation opening positioned between said second ventilation opening and said third ventilation opening.

12. A reflective bracket in accordance with claim 9 wherein said shield is integrally formed with said channel.

13. A reflective bracket in accordance with claim 9 further comprising at least one holding bracket extending from said channel.

14. A reflective bracket in accordance with claim 13 wherein said holding bracket comprises a plurality of fingers.

15. A reflective bracket in accordance with claim 13 wherein said holding bracket is integrally formed with said channel.

* * * * *

UNITED STATES PATENT AND TRADEMARK OFFICE

CERTIFICATE OF CORRECTION

PATENT NO. : 7,046,921 B1
APPLICATION NO. : 09/480588
DATED : May 16, 2006
INVENTOR(S) : Fulks It is certified that error appears in the above-identified patent and that said Letters Patent is hereby corrected as shown below:

In Claim 9, column 4, line 41, delete "shield, configured" and insert therefor -- shield configured --.

Signed and Sealed this

Eleventh Day of September, 2007

JON W. DUDAS
*Director of the United States Patent and Trademark Office*